US008477088B2

(12) United States Patent
Ozawa

(10) Patent No.: US 8,477,088 B2
(45) Date of Patent: Jul. 2, 2013

(54) DISPLAY DEVICE AND DISPLAY DRIVING METHOD INCLUDING A VOLTAGE CONTROLLER AND A SIGNAL AMPLITUDE REFERENCE VOLTAGE CHANGER

(75) Inventor: Atsushi Ozawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 1353 days.

(21) Appl. No.: 12/222,856

(22) Filed: Aug. 18, 2008

(65) Prior Publication Data

US 2009/0079678 A1 Mar. 26, 2009

(30) Foreign Application Priority Data

Sep. 20, 2007 (JP) ..... 2007-243607

(51) Int. Cl.
*G09G 3/30* (2006.01)

(52) U.S. Cl.
USPC ..... 345/77

(58) Field of Classification Search
USPC ..... 345/87–100, 690, 76–83; 315/169.3
See application file for complete search history.

(56) References Cited

U.S. PATENT DOCUMENTS 6,479,940 B1 * 11/2002 Ishizuka ..... 315/169.3
7,173,591 B2 * 2/2007 Monomohshi ..... 345/96
2005/0122321 A1 * 6/2005 Akai et al. ..... 345/204
2005/0206592 A1 9/2005 Amano
2007/0001940 A1 * 1/2007 Jo ..... 345/77
2007/0268242 A1 * 11/2007 Baba et al. ..... 345/102

FOREIGN PATENT DOCUMENTS

JP 2002-215097 A 7/2002
JP 2005-141148 A 6/2005
JP 2005-301234 10/2005
JP 2007-147866 A 6/2007

OTHER PUBLICATIONS

Japanese Office Action issued Aug. 25, 2009 for corresponding Japanese Applcation No. 2007-243607.

* cited by examiner

*Primary Examiner* — Rodney Amadiz
(74) *Attorney, Agent, or Firm* — Rader, Fishman & Grauer PLLC

(57) ABSTRACT

A display device includes a display panel unit configured to include pixel circuits in each of which an organic electroluminescence device is used as a light emitting device and is driven to emit light with luminance dependent upon a voltage difference between a signal value voltage of an input display data signal and a signal amplitude reference voltage. The display device further includes: a voltage controller configured to carry out grayscale value detection for a display data signal to be supplied to the display panel unit in every predetermined period, and create voltage control information of the signal amplitude reference voltage by using a detected grayscale value; and a signal amplitude reference voltage changer configured to change a voltage value of the signal amplitude reference voltage to be supplied to the pixel circuits of the display panel unit, based on voltage control information created by the voltage controller.

12 Claims, 9 Drawing Sheets

DISPLAY DEVICE AND DISPLAY DRIVING METHOD INCLUDING A VOLTAGE CONTROLLER AND A SIGNAL AMPLITUDE REFERENCE VOLTAGE CHANGER

CROSS REFERENCES TO RELATED APPLICATIONS

The present invention contains subject matter related to Japanese Patent Application JP 2007-243607 filed in the Japan Patent Office on Sep. 20, 2007, the entire contents of which being incorporated herein by reference.

BACKGROUND OF THE INVENTION

1. Field of the Invention

The present invention relates to a display device employing organic electroluminescence devices (organic EL devices) as light emitting devices and a display driving method therefor.

2. Description of the Related Art

Flat panel displays are widely used for products such as computer displays, portable terminals, and television receivers. Presently, liquid crystal display panels are mainly employed therefor. However, a narrow viewing angle and a low response speed thereof are still being pointed out. On the other hand, an organic electroluminescence (hereinafter, EL) display formed with self-luminous devices can overcome the problems of the viewing angle and the responsivity, and can achieve a small-thickness form due to no necessity for a backlight, high luminance, and high contrast. Thus, the organic EL display is expected as a next-generation display device to replace the liquid crystal display.

The kinds of drive systems for the organic EL display include a passive-matrix system and an active-matrix system similarly to the liquid crystal display. The passive-matrix system has a simpler structure but involves problems such as a difficulty in the realization of a large-size and high-definition display. Therefore, currently, the active-matrix system is being developed more actively. In the active-matrix system, the current that flows through a light emitting device in each pixel circuit is controlled by an active element (typically a thin film transistor (TFT)) provided in the pixel circuit.

SUMMARY OF THE INVENTION

Although some organic EL displays have been put into practical use, high power consumption thereof is still being regarded as a problem. For the organic EL display, suppression of the power consumption and suppression of the influence of sudden load changes are considered to be large challenges that should be dealt with, from the viewpoint of allowing decrease in the power consumption of the entire device and reduction of the scale of the power supply system, and this is common to all the display devices.

The organic EL display is a self-luminous display, and the necessary power consumption thereof is higher when the average display luminance in the screen is higher. Thus, it is considered that it is difficult to achieve both general image quality enhancement for realization of bright and beautiful displaying and power consumption reduction.

Japanese Patent Laid-open No. 2005-301234 discloses a display device that is a self-luminous display based on a passive-matrix drive system. In this display device, control of the threshold voltage and processing of expanding a video signal are carried out depending on the overall signal level of the display contents so that displaying with higher luminance may be allowed for video with a high overall signal level and darkening of black may be allowed for video with a low overall signal level. This allows the display device to have improved contrast and enhanced luminance according to this patent document.

In this case, the voltage across the self-luminous device can be controlled by paying attention on the grayscales that exist in the display contents through histogram analysis and executing processing of the threshold voltage and the video signal so that the optimum part of the voltage-luminance characteristic of the self-luminous device can be always used. However, all of this operation is to improve the image quality, i.e., to improve the contrast and enhance the luminance: not processing for decreasing the power consumption but processing involving an increase in the power consumption is executed. In addition, this technique can be applied only to passive-matrix drive operation.

There is a need for the present invention to propose a technique that allows the power consumption to be easily decreased while suppressing image quality lowering.

According to an embodiment of the present invention, there is provided a display device. The display device includes a display panel unit configured to include pixel circuits in each of which an organic electroluminescence device is used as a light emitting device and is driven to emit light with the luminance dependent upon the voltage difference between a signal value voltage of an input display data signal and a signal amplitude reference voltage, a voltage controller configured to carry out grayscale value detection for a display data signal to be supplied to the display panel unit in every predetermined period, and create voltage control information of the signal amplitude reference voltage by using a detected grayscale value, and a signal amplitude reference voltage changer configured to change the voltage value of the signal amplitude reference voltage to be supplied to the pixel circuits of the display panel unit, based on voltage control information created by the voltage controller.

According to another embodiment of the present invention, there is provided a display driving method for a display device having a display panel unit that includes pixel circuits in each of which an organic electroluminescence device is used as a light emitting device and is driven to emit light with luminance dependent upon the voltage difference between a signal value voltage of an input display data signal and a signal amplitude reference voltage. The method includes the steps of carrying out grayscale value detection for a display data signal to be supplied to the display panel unit in every predetermined period, creating voltage control information of the signal amplitude reference voltage depending on a detected grayscale value, and changing the voltage value of the signal amplitude reference voltage to be supplied to the pixel circuits of the display panel unit, based on the created voltage control information.

In the pixel circuit of an organic EL display of the active-matrix system, an active element (drive transistor) functioning as a constant current source applies a current to an organic EL device depending on the voltage difference between the signal value voltage of an input display data signal and the signal amplitude reference voltage (fixed potential, typically), and thereby the organic EL device is driven to emit light. This allows light emission with the luminance dependent upon the input signal value voltage.

The power consumption of the organic EL device is obtained by multiplying the current that flows through the organic EL device by the voltage between the anode and cathode of the organic EL device. The current to be applied to the organic EL device is determined by the desired luminance, and therefore lower light emission luminance leads to lower power consumption. However, it is obvious that decreasing the light emission luminance to an excessive extent will cause image quality lowering due to the deterioration of the grayscale reproducibility and so on.

Therefore, in the embodiments of the present invention, without executing any processing for the signal value to be input to the pixel circuit based on the display data signal, the signal amplitude reference voltage (the Vofs voltage that determines the black level of the video signal amplitude), which is typically a fixed potential, is changed to thereby control the entire luminance for power consumption reduction.

Specifically, when lower-side grayscales do not exist in the display contents, the signal amplitude reference voltage (Vofs voltage) is increased to thereby decrease the potential difference from the signal value voltage for all the pixel circuits for the frame. This is equivalent to operation of lowering the entire luminance while ensuring the grayscale reproducibility of all the pixels of the frame. This easily allows power consumption reduction while suppressing image quality lowering.

More specifically, by detecting the minimum grayscale value among the grayscale values of all the pixels of the frame, it can be known that the grayscales in the range from the 0% grayscale (the lowest luminance in the specification) to the minimum grayscale value in the frame do not exist. Therefore, even when the signal amplitude reference voltage is changed by the voltage corresponding to this range, the entire luminance can be decreased and thus the power consumption can be reduced without influence on the displayed grayscales.

According to the embodiments of the present invention, in every predetermined period (e.g. one frame), the grayscale value of a pixel is detected and the signal amplitude reference voltage is changed based on this grayscale value. This feature lowers the entire luminance without deteriorating the grayscale characteristic of the display contents. In particular, if the minimum grayscale value of each frame is detected, the allowed increase amount of the signal amplitude reference voltage can be properly determined, with consideration of the image quality, i.e., luminance variation, without deteriorating the reproducibility of the existing grayscales.

This feature offers an advantageous effect that suppression of the entire luminance, i.e., suppression of the power consumption, can be realized while image quality lowering is suppressed to the minimum through simple control: the change of the signal amplitude reference voltage.

DETAILED DESCRIPTION OF THE PREFERRED EMBODIMENTS

A display device and a display driving method according to embodiments of the present invention will be described below.

Figure 1:
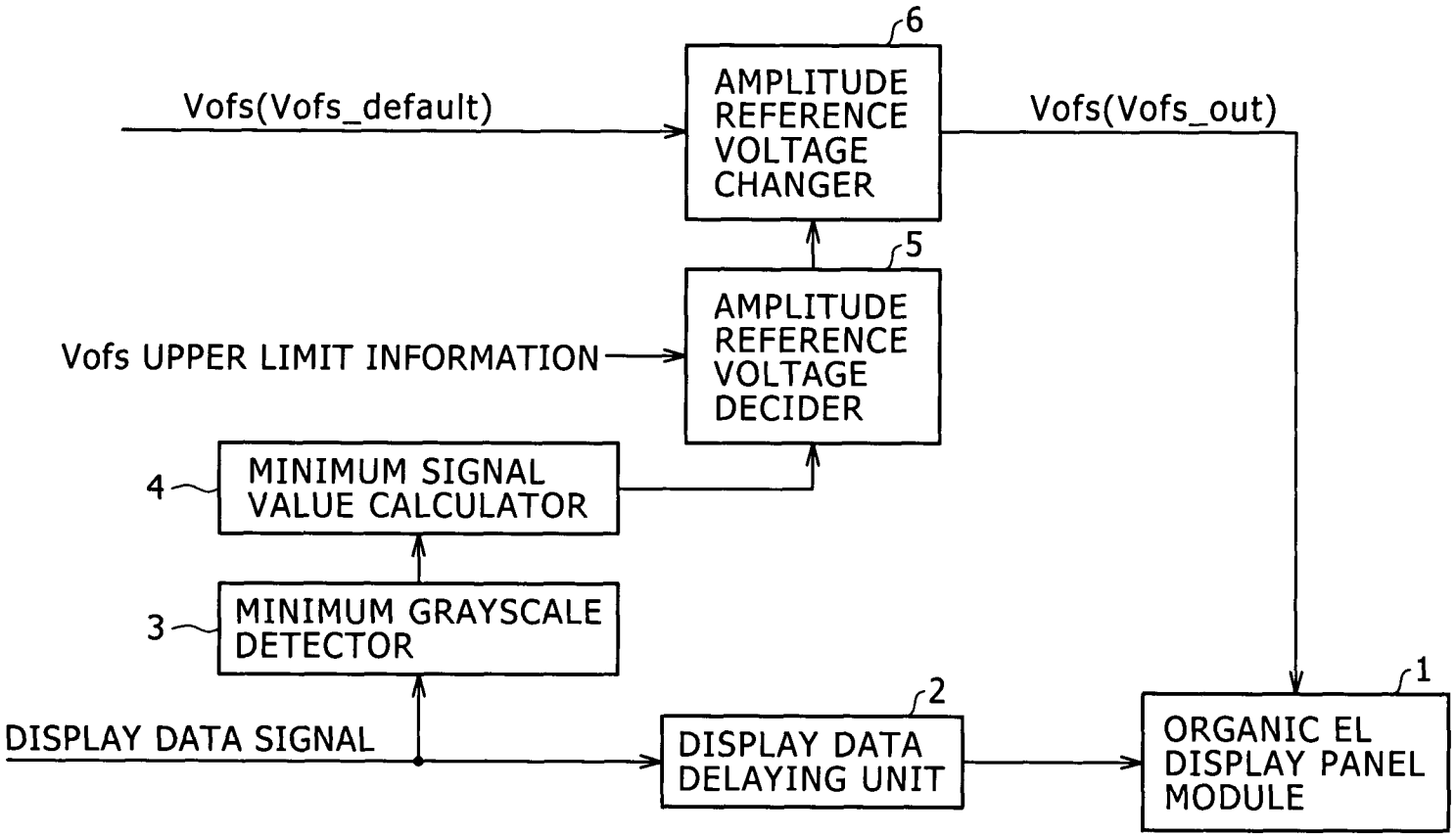
FIG. 1 is a block diagram of the configuration of a display device according to an embodiment of the present invention.

FIG. 1 shows the configuration of the display device of the embodiment. The display device of the present example includes an organic EL display panel module 1 in which organic EL devices are used as light emitting devices, a display data delaying unit 2, a minimum grayscale detector 3, a minimum signal value calculator 4, an amplitude reference voltage decider 5, and an amplitude reference voltage changer 6.

Initially the organic EL display panel module 1 will be described below with reference to FIGS. 2, 3, and 4.

Figure 2:
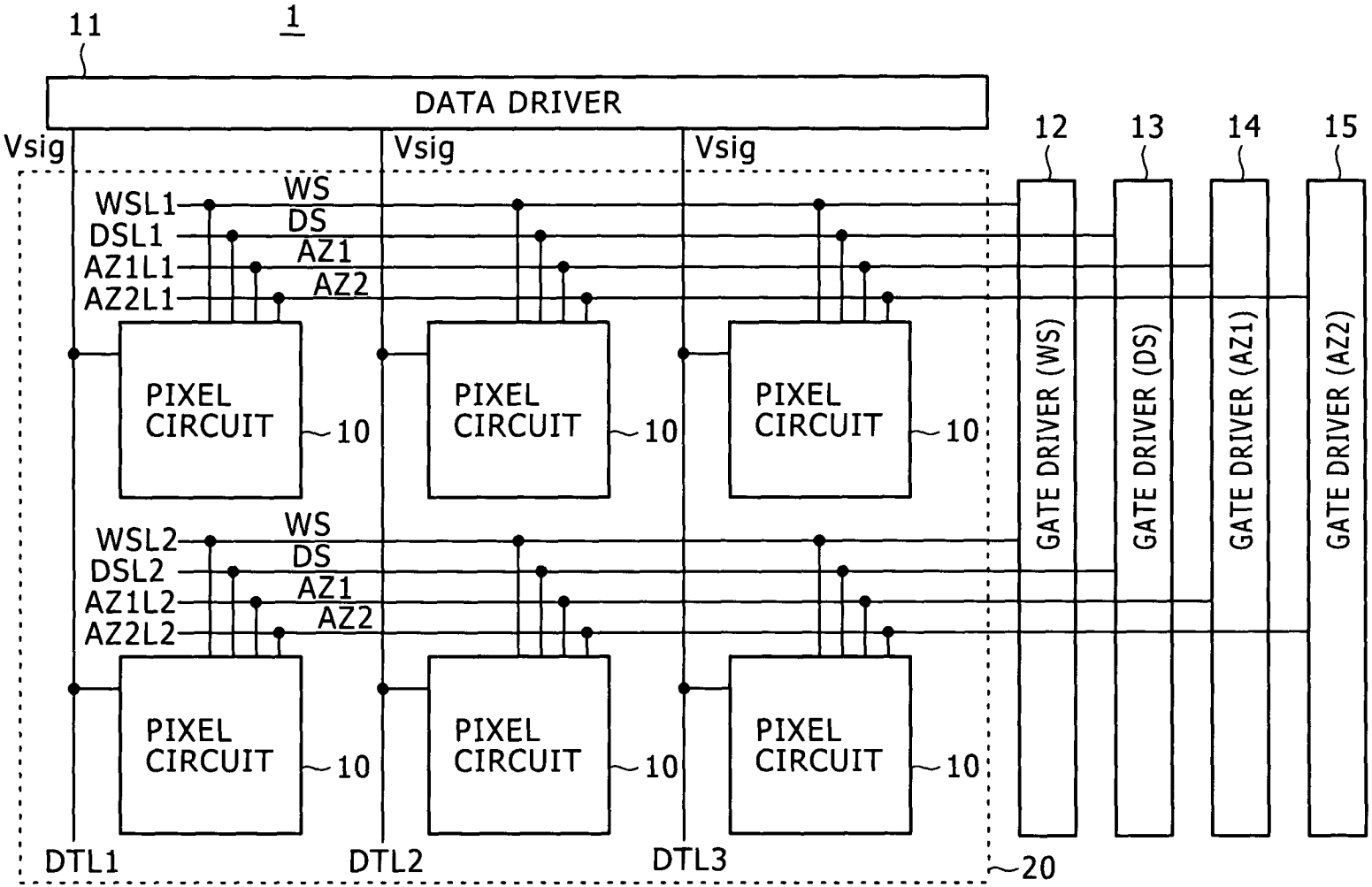
FIG. 2 is an explanatory diagram of an organic EL display panel module according to the embodiment.

FIG. 2 shows one example of the configuration of the organic EL display panel module 1. This organic EL display panel module 1 includes pixel circuits 10 which each include an organic EL device as a light emitting device and carry out light emission driving based on an active-matrix system.

As shown in FIG. 2, the organic EL display panel module 1 includes a pixel array part 20 in which the pixel circuits 10 are arranged in a matrix along the column direction and the row direction, a data driver 11, and gate drivers 12, 13, 14, and 15.

Signal lines DTL1, DTL2 . . . are arranged along the column direction of the pixel array part 20. The signal lines DTL1, DTL2 . . . are selected by the data driver 11 and supply a signal value Vsig corresponding to a supplied display data signal as an input signal to the pixel circuit 10. The number of signal lines DTL1, DTL2 . . . is the same as that of columns of the pixel circuits 10 arranged in a matrix in the pixel array part 20.

Furthermore, scan lines WSL1, WSL2 . . . , scan lines DSL1, DSL2 . . . , scan lines AZ1L1, AZ1L2 . . . , and scan lines AZ2L1, AZ2L2 . . . are arranged along the row direction of the pixel array part 20. Each of the numbers of scan lines WSL, DSL, AZ1L, and AZ2L is the same as that of rows of the pixel circuits 10 arranged in a matrix in the pixel array part 20.

The scan lines WSL (WSL1, WSL2 . . . ) are to carry out writing of the signal value Vsig to the pixel circuits 10 (write scan) and are driven by the gate driver 12. The gate driver 12 sequentially supplies a scan pulse WS to the respective scan lines WSL1, WSL2 . . . arranged on the rows at the predetermined timings to thereby line-sequentially scan the pixel circuits 10 on a row-by-row basis.

The scan lines DSL (DSL1, DSL2 . . . ) are driven by the gate driver 13. The gate driver 13 supplies a scan pulse DS for light emission driving of the organic EL device to the respective power supply lines DSL1, DSL2 . . . arranged on the rows at the predetermined timings.

The scan lines AZ1L (AZ1L1, AZ1L2 . . . ) are driven by the gate driver 14. The gate driver 14 supplies a scan pulse AZ1 for supply of a reset voltage (Vrs) for the pixel circuit 10 to the respective scan lines AZ1L1, AZ1L2 . . . arranged on the rows at the predetermined timings.

The scan lines AZ2L (AZ2L1, AZ2L2 . . . ) are driven by the gate driver 15. The gate driver 15 supplies a scan pulse AZ2 for supply of a signal amplitude reference voltage (Vofs)

to the pixel circuit 10 to the respective scan lines AZ2L1, AZ2L2 . . . arranged on the rows at the predetermined timings.

In linkage with the line-sequential scanning by the gate driver 12, the data driver 11 supplies the signal value (Vsig) to the signal lines DTL1, DTL2 . . . arranged along the column direction as the input signal to the pixel circuits 10.

Figure 3:
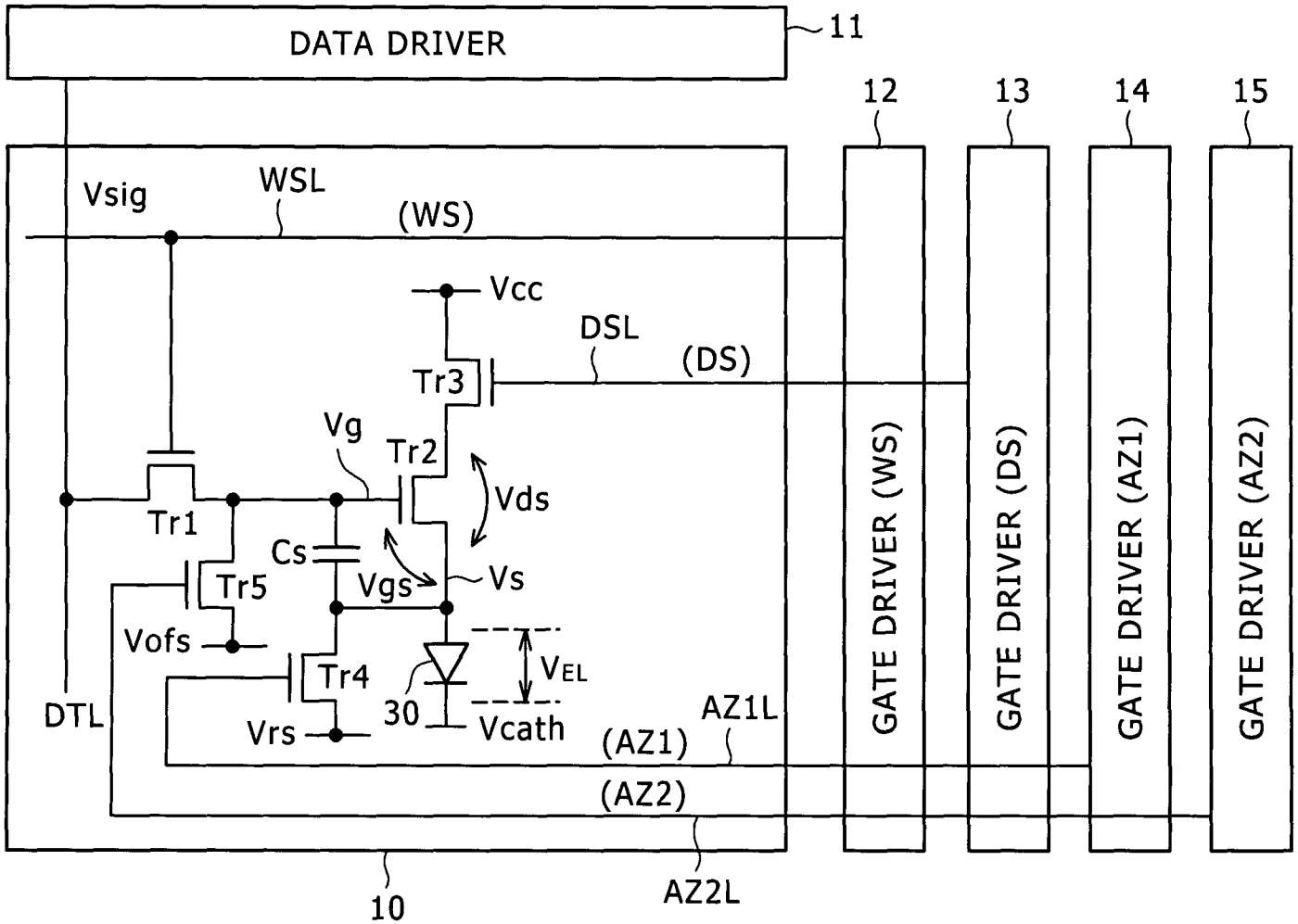
FIG. 3 is an explanatory diagram of a pixel circuit according to the embodiment.

FIG. 3 shows the configuration of the pixel circuit 10. This pixel circuit 10 is disposed on a matrix as shown in the configuration of FIG. 2. It should be noted that FIG. 3 shows only one pixel circuit 10 disposed at the intersection between the signal line DTL and the scan lines WSL, DSL, AZ1L, and AZ2L for simplification.

Various configurations will be available as the configuration of the pixel circuit 10 that can be employed as the embodiment. In the present example, the pixel circuit 10 includes an organic EL device 30 as a light emitting device, one holding capacitor Cs, and the following five thin film transistors (TFTs): a sampling transistor Tr1, a drive transistor Tr2, a switching transistor Tr3, a reset transistor Tr4, and an amplitude reference setting transistor Tr5. Each of the transistors Tr1, Tr2, Tr3, Tr4, and Tr5 is an n-channel TFT.

One terminal of the holding capacitor Cs is connected to the source of the drive transistor Tr2, and the other terminal thereof is connected to the gate of the drive transistor Tr2.

The light emitting device in the pixel circuit 10 is the organic EL device 30 having a diode structure and has the anode and the cathode. The anode of the organic EL device 30 is connected to the source of the drive transistor Tr2, and the cathode thereof is connected to a predetermined ground line (cathode potential Vcath).

One of the drain and source of the sampling transistor Tr1 is connected to the signal line DTL, and the other is connected to the gate of the drive transistor Tr2. The gate of the sampling transistor is connected to the scan line WSL.

One of the drain and source of the switching transistor Tr3 is connected to a supply voltage Vcc, and the other thereof is connected to the drain of the drive transistor Tr2. The gate of the switching transistor Tr3 is connected to the scan line DSL.

One of the drain and source of the reset transistor Tr4 is connected to the source of the drive transistor Tr2, and the other thereof is connected to the reset potential Vrs. The gate of the reset transistor Tr4 is connected to the scan line AZ1L.

One of the drain and source of the amplitude reference setting transistor Tr5 is connected to the gate of the drive transistor Tr2, and the other thereof is connected to the supply line of the signal amplitude reference voltage Vofs. The gate of the amplitude reference setting transistor Tr5 is connected to the scan line AZ2L.

Figures 4A, 4B, 4C, 4D, 4E, 4F, 4G, 4H:
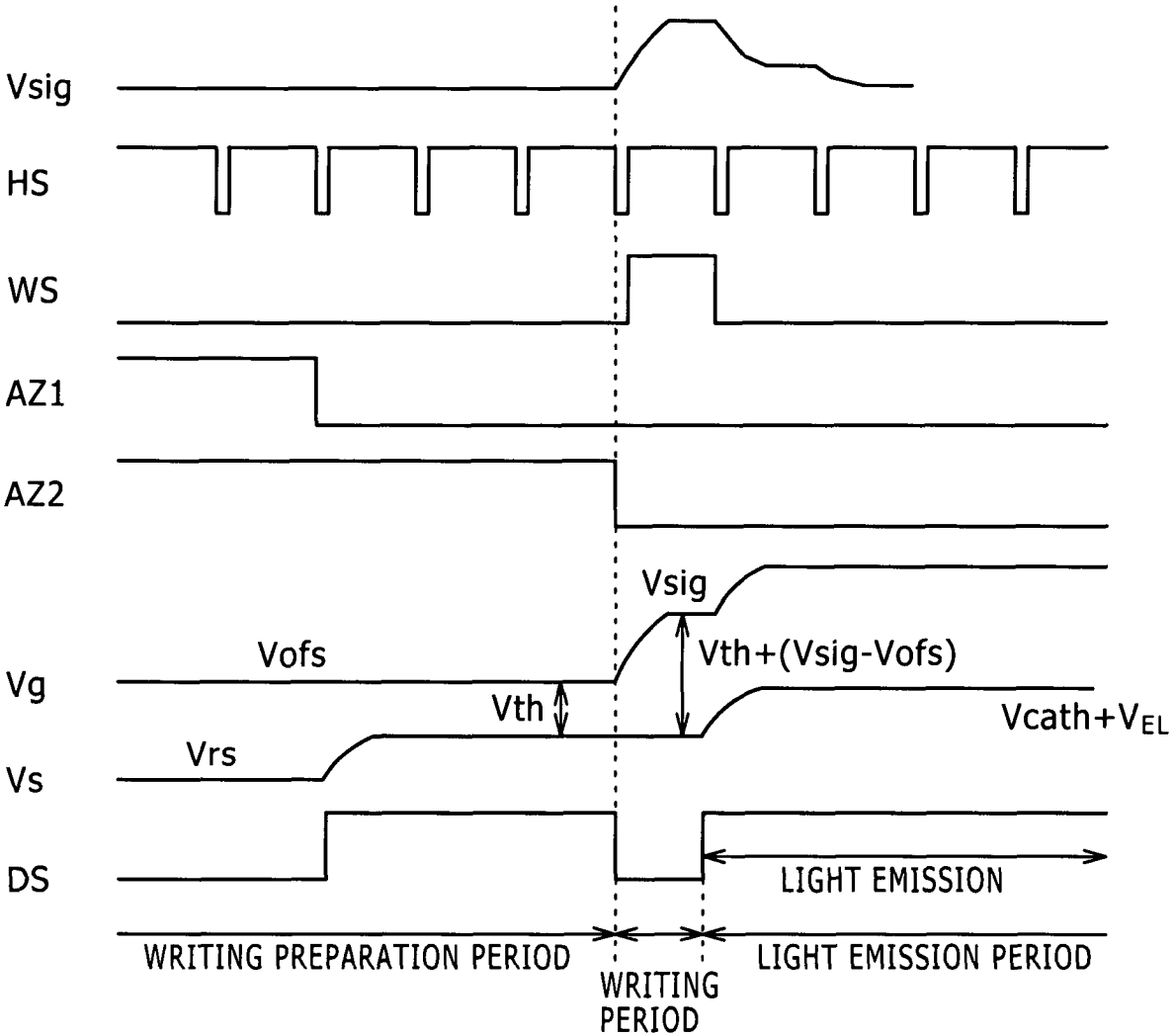
FIG. 4A to FIG. 4H is an explanatory diagram of the operation of the pixel circuit according to the embodiment.

The operation of this pixel circuit 10 will be simply described below with reference to FIG. 4. FIG. 4A shows the signal value Vsig supplied to the signal line DTL. FIG. 4B shows a horizontal synchronizing signal HS. FIG. 4C shows the scan pulse WS supplied from the scan line WSL to the gate of the sampling transistor Tr1. FIG. 4D shows the scan pulse AZ1 supplied from the scan line AZ1L to the gate of the reset transistor Tr4. FIG. 4E shows the scan pulse AZ2 supplied from the scan line AZ2L to the gate of the amplitude reference setting transistor Tr5. FIG. 4F shows the gate voltage Vg of the drive transistor Tr2. FIG. 4G shows the source voltage Vs of the drive transistor Tr2. FIG. 4H shows the scan pulse DS supplied from the scan line DSL to the gate of the switching transistor Tr3.

The start timing of the horizontal scanning is determined by the horizontal synchronizing signal HS. At the start of a writing preparation period of FIG. 4A to FIG. 4H, the reset transistor Tr4 and the amplitude reference setting transistor Tr5 are set to the conductive state by the scan pulses AZ1 and AZ2. Due to this operation, the gate voltage Vg of the drive transistor Tr2 is set to the signal amplitude reference voltage Vofs, and the source voltage Vs of the drive transistor Tr2 is set to the reset voltage Vrs. The potential difference between the signal amplitude reference voltage Vofs and the reset voltage Vrs is so designed as to be sufficiently larger than the threshold voltage Vth of the drive transistor Tr2.

Subsequently, at a predetermined timing, the scan pulse AZ1 is turned to the L level, and the scan pulse DS is turned to the H level. That is, the reset transistor Tr4 is turned off, and the switching transistor Tr3 is turned on. Due to this operation, the supply voltage Vcc is applied to the drain of the drive transistor Tr2, and the source of the drive transistor Tr2 is isolated from the reset voltage Vrs. At this time, a current flows between the drain and source of the drive transistor Tr2, so that the source voltage Vs of the drive transistor Tr2 gradually rises up. At the timing when a voltage Vgs between the gate and source of the drive transistor Tr2 (hereinafter, referred to as the gate-source voltage Vgs) has reached the threshold voltage Vth, the current between the drain and the source stops (cut-off state). From then on, the source voltage Vs is equal to such a potential as to maintain the state in which the gate-source voltage Vgs is equal to the threshold voltage Vth.

The purpose of setting the gate-source voltage Vgs equal to the threshold voltage Vth is to cancel the influence of variation in the threshold voltage Vth from device to device.

Thereafter, in a writing period, the signal value Vsig is applied to the signal line DTL by the data driver 11, so that writing of the signal value Vsig to the pixel circuit 10 is carried out.

In this writing period, the scan pulse DS is turned to the L level, so that the application of the supply voltage Vcc is stopped. Furthermore, the scan pulse AZ2 is turned to the L level, so that the fixing of the gate potential at the signal amplitude reference voltage Vofs is released. In addition, the sampling transistor Tr1 is turned on by the scan pulse WS, and thereby the signal value Vsig from the signal line DTL is written to the holding capacitor Cs.

In this writing period, the gate voltage of the drive transistor Tr2 rises up in response to the writing of the signal value Vsig to the holding capacitor Cs. As a result, the gate-source voltage Vgs of the drive transistor Tr2 becomes Vth+(Vsig−Vofs).

Subsequently to the writing period, operation of a light emission period is carried out. In the light emission period, the scan pulse WS is turned to the L level and thereby the sampling transistor Tr1 is turned off. On the other hand, the switching transistor Tr3 is turned on by the scan pulse DS. Thereby, due to current supply from the drive supply voltage Vcc, the drive transistor Tr2 applies the current dependent upon the signal potential held by the holding capacitor Cs (i.e. the gate-source voltage of the drive transistor Tr2) to the organic EL device 30, to thereby cause the organic EL device 30 to emit light. The drive transistor Tr2 operates in the saturation region and functions as a constant current source that supplies the drive current dependent upon the signal value Vsig to the organic EL device 30.

Due to the current flowing through the organic EL device 30, a voltage $V_{EL}$ across the organic EL device 30 rises up. Therefore, at the initial stage of the light emission period, the gate voltage Vg and the source voltage Vs of the drive transistor Tr2 rise up in linkage with the rise of the voltage $V_{EL}$. Specifically, the source voltage Vs rises up to a potential of Vcath+$V_{EL}$, and the gate voltage Vg rises up in such a manner as to keep a potential difference of Vth+(Vsig−Vofs) from the source voltage Vs.

Through the above-described operation, the light emission driving of the pixel circuit 10 is carried out.

Referring back to FIG. 1, the configuration of the present example will be described below.

The display data signals are supplied to the display data delaying unit 2 and the minimum grayscale detector 3.

The display data delaying unit 2 delays the display data signals by a predetermined time and supplies the delayed signal to the organic EL display panel module 1. The purpose of the delaying by the display data delaying unit 2 is to allow proper reflection of change control of the signal amplitude reference voltage Vofs by the operation of the units from the minimum grayscale detector 3 to the amplitude reference voltage changer 6 in matching with the display contents. The display data delaying unit 2 delays the display data signals with use of a frame memory and so on by the time designed in consideration of the delay due to the processing by the units from the minimum grayscale detector 3 to the amplitude reference voltage changer 6.

In the organic EL display panel module 1, with the above-described configuration, the light emission driving of the respective pixels is carried out based on the supplied display data signals.

The minimum grayscale detector 3 detects the minimum grayscale value in one frame of the display data signals for each of the colors of the pixels.

The minimum grayscale value detected by the minimum grayscale detector 3 refers to the value that will offer the lowest luminance among the luminance values given to the respective pixels in certain one frame. That is, the minimum grayscale value refers to the display data signal value for the pixel that will be caused to emit light with the lowest luminance in one frame.

This minimum grayscale value is detected for each of the display colors of red (R), green (G), and blue (B).

Specifically, comparison processing is sequentially executed for the display data signals to the respective R pixel circuits for one frame, to thereby detect the value of the lowest luminance as an R minimum grayscale value Smin_r. Similarly, the value of the lowest luminance among the display data signals to the respective G pixel circuits for one frame is detected as a G minimum grayscale value Smin_g. Furthermore, the value of the lowest luminance among the display data signals to the respective B pixel circuits in one frame is detected as a B minimum grayscale value Smin_b.

Subsequently, the minimum grayscale values Smin_r, Smin_g, and Smin_b of the respective colors in this one frame are output to the minimum signal value calculator 4.

A frame memory may be prepared for the minimum grayscale detector 3 so that the display data signal values of the one-frame period may be temporarily stored and the minimum grayscale value of each of R, G, and B may be detected from the stored values.

The minimum signal value calculator 4 converts the minimum grayscale values Smin_r, Smin_g, and Smin_b of the respective colors into the output voltage values of the data driver 11 (voltage values as the signal value Vsig). Subsequently, the minimum signal value calculator 4 selects the minimum value from these output voltage values and outputs the selected value to the amplitude reference voltage decider 5 as the minimum signal value (Vsig(Smin)).

The amplitude reference voltage decider 5 decides the signal amplitude reference voltage Vofs to be given to the respective pixel circuits 10 based on the input minimum signal value (Vsig(Smin)).

Specifically, initially the amplitude reference voltage decider 5 subtracts the signal value (Vsig(0)) corresponding to the 0% grayscale from the minimum signal value (Vsig(Smin)) of the frame to thereby work out a difference (ΔVsig(MIN)) that indicates the difference between the 0%-grayscale signal value Vsig(0) and the minimum signal value (Vsig(Smin)) on a frame-by-frame basis. Subsequently, the amplitude reference voltage decider 5 adds the difference ΔVsig(MIN) to the default value of the signal amplitude reference voltage Vofs (Vofs_default), to thereby decide the signal amplitude reference voltage Vofs to be given to the pixel circuits 10.

To the amplitude reference voltage decider 5, Vofs upper limit information is input. The amplitude reference voltage decider 5 decides the value of the signal amplitude reference voltage Vofs to be given to the pixel circuits 10 in such a way that the decided value does not surpass the value of this Vofs upper limit information. That is, the amplitude reference voltage decider 5 selects the smaller value from the voltage value as the Vofs upper limit information and the voltage value obtained by adding the difference ΔVsig(MIN) to the default value of the signal amplitude reference voltage Vofs (Vofs_default) as described above.

The operation of adding the difference ΔVsig(MIN) to the default value of the signal amplitude reference voltage Vofs (Vofs_default) to thereby decide the value of the signal amplitude reference voltage Vofs to be given to the pixel circuits 10 in the amplitude reference voltage decider 5 is equivalent to collapsing of the grayscales from the 0% grayscale to the minimum grayscale on the display. However, this operation leads to no problem because the grayscales under the minimum grayscale value do not exist in the frame.

The amplitude reference voltage changer 6 converts the signal amplitude reference voltage Vofs set as the predetermined initial voltage value (Vofs_default) to a voltage value (Vofs_out), and supplies this value to the organic EL display panel module 1. The signal amplitude reference voltage Vofs (Vofs_out) output from the amplitude reference voltage changer 6 is supplied to all the pixel circuits 10 in the organic EL display panel module 1 in common.

This drive voltage changer 6 converts the input initial voltage value (Vofs_default) to the voltage value (Vofs_out) decided by the amplitude reference voltage decider 5, and supplies this voltage value to the organic EL display panel module 1 as the signal amplitude reference voltage Vofs. An example of the voltage conversion method will be described later.

The operation of the display device of the present example will be described below.

Figure 5:
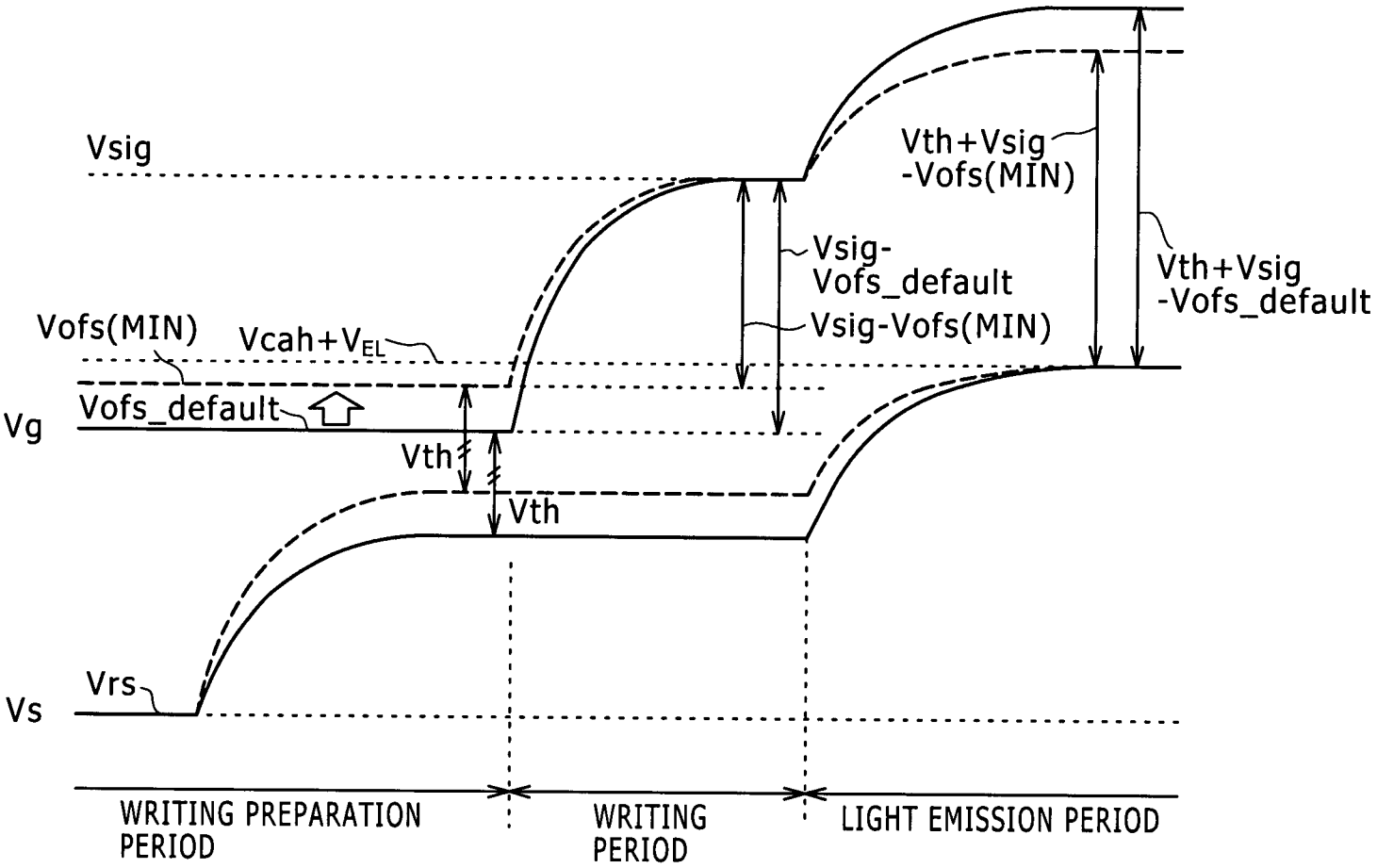
FIG. 5 is an explanatory diagram of a change in the gate-source voltage due to a change in a signal amplitude reference voltage according to the embodiment.

Referring initially to FIG. 5, a description will be made below about a change in the gate-source voltage Vgs of the drive transistor Tr2, i.e., a change in the gate-source voltage Vgs for which the signal value Vsig is to be written, in the case in which the value of the signal amplitude reference voltage Vofs is changed.

In FIG. 5, the gate voltage Vg and the source voltage Vs of the drive transistor Tr2 are shown. The solid lines arise from enlargement of the lines indicating the potential changes described with FIG. 4, and the dashed lines indicate the potential changes in the case in which the signal amplitude reference voltage Vofs is changed in the present example.

Initially the potential changes of the normal case, indicated by the solid lines, will be described below. The "normal case" refers to the case in which the signal amplitude reference voltage Vofs is set to the default value (Vofs_default) as the predetermined initial voltage value.

As described above, initially in the writing preparation period, the gate voltage Vg is set to Vofs (=Vofs_default) and the source voltage Vs is set to the reset voltage Vrs.

In this state, the supply of the reset voltage Vrs to the source voltage Vs is stopped, and the supply voltage Vcc is provided to the drain of the drive transistor Tr2. Due to this operation, the gradual rise of the source voltage Vs starts, and when the gate-source voltage Vgs has become equal to the threshold voltage Vth of the drive transistor Tr2, the flow of a current Ids stops (cut-off state). From then on, the voltage Vth is held as the gate-source voltage Vgs.

At a predetermined timing, the supply of the signal amplitude reference voltage Vofs (=Vofs_default) to the gate is stopped, and the supply of the signal value Vsig is started. Due to this operation, a voltage of "Vsig−Vofs_default" is added to the voltage Vth as the gate-source voltage Vgs, and then a bootstrap phenomenon occurs concurrently with the generation of the voltage $V_{EL}$ across the organic EL device 30. Thus, a voltage of "Vth+(Vsig−Vofs_default)" is written as the gate-source voltage Vgs finally.

Therefore, in the light emission period, the current dependent upon the gate-source voltage Vgs (=Vth+(Vsig−Vofs_default)) flows through the organic EL device 30, so that light emission with the luminance dependent upon this gate-source voltage Vgs is obtained.

Next, a description will be made below about the case in which the signal amplitude reference voltage Vofs is increased from the initial voltage value Vofs_default to the voltage value Vofs (MIN). This voltage value Vofs(MIN) refers to a certain voltage value that arises from a change from the initial voltage value Vofs_default and is supplied from the amplitude reference voltage changer 6 of FIG. 1 as the signal amplitude reference voltage Vofs (=Vofs_out).

This case is indicated by the dashed lines in FIG. 5.

Initially in the writing preparation period, the gate voltage Vg is set to Vofs (=Vofs(MIN)) and the source voltage Vs is set to the reset voltage Vrs.

Subsequently, for the operation of cancelling variation in the threshold Vth, the supply of the reset voltage Vrs to the source of the drive transistor Tr2 is stopped, and the supply voltage Vcc is provided to the drain of the drive transistor Tr2. Due to this operation, the source voltage Vs rises up similarly to the above-described normal case, and when the gate-source voltage Vgs has become equal to the threshold voltage Vth of the drive transistor Tr2, the flow of the current Ids stops. From then on, the voltage Vth is held as the gate-source voltage Vgs.

As is apparent from FIG. 5, after the gate-source voltage Vgs has become the voltage Vth, the source voltage Vs in the case of the dashed lines is higher than that in the normal case indicated by the solid lines. That is, corresponding to the increase of the signal amplitude reference voltage Vofs from the initial voltage value Vofs_default to the voltage value Vofs(MIN), the source voltage Vs increases.

In the writing period, the signal value Vsig is written. As shown in FIG. 5, the voltage Vsig and the voltage Vth do not vary, and therefore a voltage lowered by "Vofs(MIN)−Vofs_default" is written as the gate-source voltage Vgs finally.

Therefore, in the light emission period, the current dependent upon the gate-source voltage Vgs (=Vth+(Vsig−Vofs(MIN)) flows through the organic EL device 30, so that light emission with the luminance dependent upon this gate-source voltage Vgs is obtained.

That is, in the case indicated by the dashed lines, in which the signal amplitude reference voltage Vofs is equal to Vofs (MIN), the gate-source voltage Vgs is lower and thus the light emission luminance of the organic EL device 30 is decreased compared with the case indicated by the solid lines, in which the signal amplitude reference voltage Vofs is equal to Vofs_default. Due to the decrease of the light emission luminance, the power consumption is reduced.

In this way, the gate-source voltage Vgs can be decreased corresponding to the increase of the signal amplitude reference voltage Vofs, and thus the entire luminance can be easily controlled. Moreover, decreasing the entire luminance can realize power consumption reduction.

Figure 6:
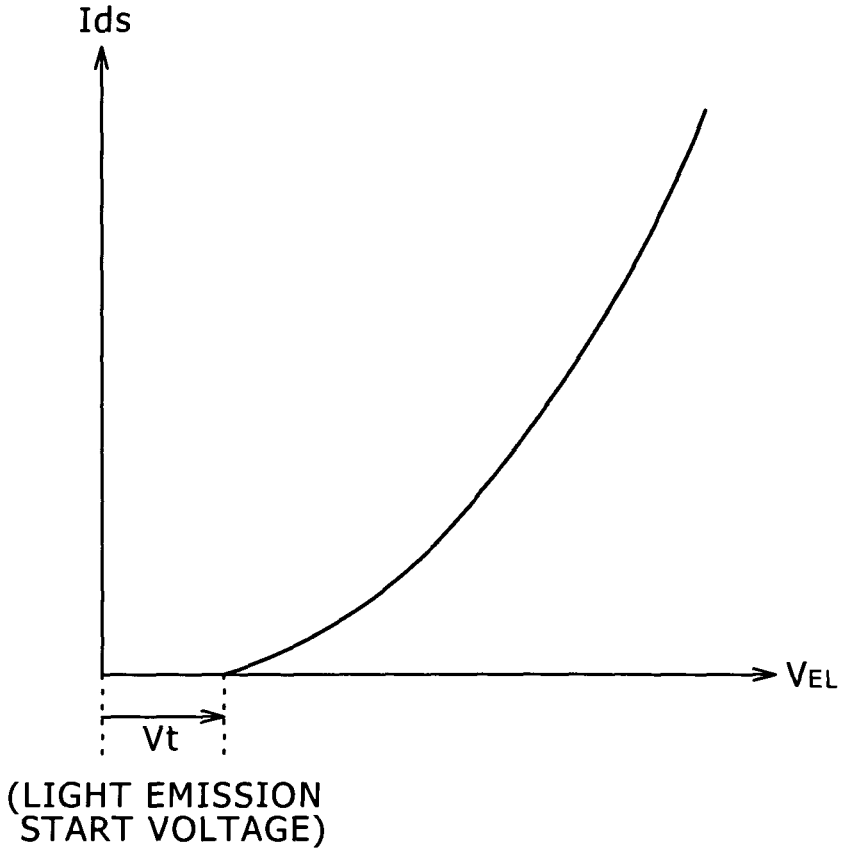
FIG. 6 is an explanatory diagram of the I-V characteristic of an organic EL device.

However, attention should be so paid that the signal amplitude reference voltage Vofs is not increased excessively. In the pixel operation, during the operation of canceling characteristic variation in the threshold voltage Vth in the writing preparation period, a potential of Vofs−Vth is applied to the anode electrode of the organic EL device 30. If a current flows through the organic EL device 30 in this state, a trouble will occur in the correct cancel operation. FIG. 6 shows the I-V characteristic of the organic EL device 30. If the voltage $V_{EL}$ across the organic EL device 30 surpasses a light emission start voltage Vt, current flowing through the organic EL device 30 starts.

Thus, the upper limit of the signal amplitude reference voltage Vofs should be set so that the voltage Vofs−Vth will not surpass the light emission start voltage Vth of the organic EL device. Therefore, as described above, the Vofs upper limit information designed in consideration of this point is set in the amplitude reference voltage decider 5 so that the signal amplitude reference voltage Vofs can be varied (increased) within a range under this upper limit.

Figure 7:
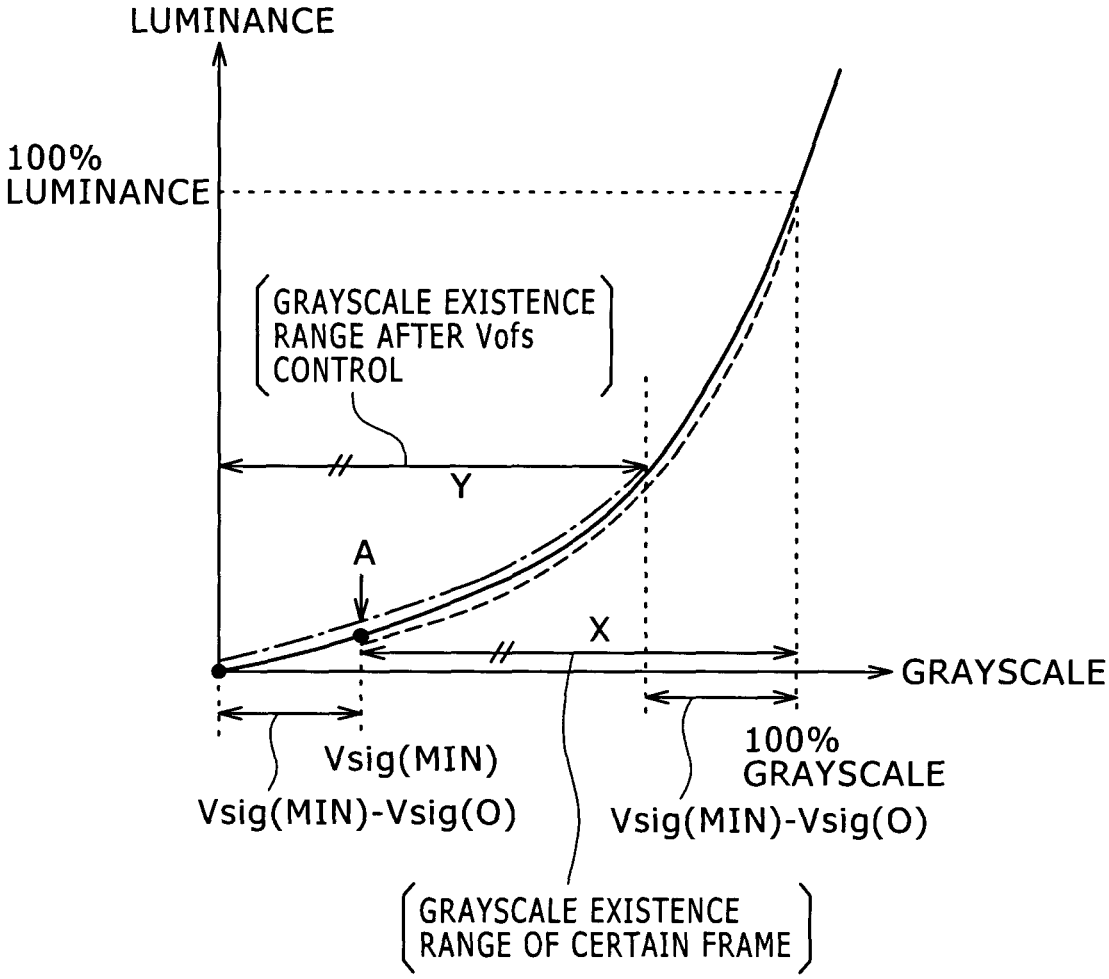
FIG. 7 is an explanatory diagram of a feature that the grayscale characteristic is maintained by the operation according to the embodiment.

FIG. 7 is a diagram for explaining the relationship between the minimum grayscale value of a frame and the value of the signal amplitude reference voltage Vofs.

In the present example, as described above, power saving is achieved by increasing the signal amplitude reference voltage Vofs to thereby decrease the entire light emission luminance as a result.

However, in the present example, the lowering of the displayed image quality is not caused although the luminance decreases.

The basic concept of the operation of the present example is as follows. Specifically, when lower-side grayscales do not exist in the distribution of the grayscales of one frame, the grayscale reproducibility of the range in which these lower-side grayscales do not exist is collapsed to thereby slide the entire luminance toward the lower-luminance side. The collapsed grayscale range is equivalent to the range that does not exist in the frame, and therefore the grayscale reproducibility of the display contents is ensured.

This feature is shown in FIG. 7. In FIG. 7, the abscissa indicates the grayscale, and the ordinate indicates the luminance.

The example of FIG. 7 is based on an assumption that the grayscale-luminance characteristic of a certain display is indicated by the solid line of FIG. 7 (suppose that the exponent of the curve is 2.2) and the minimum grayscale value of a certain frame is at the position indicated by "A". In this case, the grayscale range that exists in this frame is indicated by an arrowhead X. As for the solid-line characteristic, the range indicated by the dashed line exists in this frame.

If the relationship between the grayscale and the output voltage of the data driver 11 (signal value Vsig) is linear, the voltages from the signal value Vsig(MIN) corresponding to the minimum grayscale value to the signal value Vsig(0) corresponding to the 0% grayscale are not output from the data driver 11. Therefore, even if the signal amplitude reference voltage Vofs increases corresponding to this voltage range, the grayscale reproducibility of the display contents is not affected.

Thus, if the signal amplitude reference voltage Vofs is increased by "Vsig(MIN)−Vsig(0)", the range of the luminance characteristic corresponding to the potential written to the pixel circuit 10 as the signal value Vsig is indicated by the one-dot chain line shown along the solid line, and the grayscale existence range is indicated by an arrowhead Y.

That is, this is equivalent to the fact that the entire luminance can be decreased without deteriorating the reproducibility of the existing grayscales.

Depending on the case, the change in the entire luminance will be so large that the change can be visually recognized due to a large luminance change width, and this luminance change will be felt as image quality lowering. To address this problem, the limit value may be set for the luminance change width.

For this purpose, the upper limit of the signal amplitude reference voltage Vofs is set as described above.

Furthermore, as another example, the change upper limit may be decided based on the change amount with respect to the 100% luminance. For example, as a rough measure, this upper limit may be set to equal to or lower than the potential corresponding to ⅛ (12.5%) in the grayscale value in consideration of the decrease of the light emission luminance corresponding to the maximum grayscale to ¾ (75%), on condition that the image quality is not significantly deteriorated. Such an extent of the entire luminance change will not cause a viewer to feel image quality lowering.

As described above, in the present example, the minimum grayscale value in a frame is detected and the change amount of the signal amplitude reference voltage Vofs is calculated to thereby change the signal amplitude reference voltage Vofs to be supplied to the respective pixel circuits 10. By this feature, the entire luminance is controlled with the grayscale reproducibility kept, to thereby reduce the power consumption.

The procedure of the operation from the detection of the minimum grayscale value to the change of the signal amplitude reference voltage Vofs will be described below with reference to FIG. 8.

Initially, as processing <S1>, the minimum grayscale detector 3 detects the minimum grayscale values Smin_r, Smin_g, and Smin_b of the respective display colors in one frame of the display data signal.

Subsequently, as processing <S2>, the minimum signal value calculator 4 converts the minimum grayscale values Smin_r, Smin_g, and Smin_b to the output voltage values of the data driver 11 (voltage values as the signal value Vsig). Subsequently, the minimum signal value calculator 4 selects the minimum value from these output voltage values and defines the selected value as the minimum signal value (Vsig (Smin)).

Subsequently, as processing <S3>, the amplitude reference voltage decider 5 calculates the difference (ΔVsig(MIN)) between the minimum signal value (Vsig(Smin)) and the signal value (Vsig(0)) corresponding to the 0% grayscale of the color of this minimum signal value (Vsig(Smin)) (i.e. ΔVsig(MIN)=Vsig(Smin)−Vsig(0)).

Subsequently, as processing <S4>, the amplitude reference voltage decider 5 adds the difference ΔVsig(MIN) to the default value (Vofs_default) of the signal amplitude reference voltage Vofs, to thereby work out the value (Vofs_out) of the signal amplitude reference voltage Vofs that should be supplied to the pixel circuits 10 (Vofs_out=Vofs_default+ΔVsig (MIN)).

In this way, the amplitude reference voltage decider 5 decides the signal amplitude reference voltage Vofs (Vofs_out) dependent upon the minimum grayscale value, and outputs this information to the amplitude reference voltage changer 6. Due to this operation, the voltage conversion of the signal amplitude reference voltage Vofs is carried out in the amplitude reference voltage changer 6.

As described above, if the obtained voltage value Vofs_out surpasses the Vofs upper limit information, the value of the signal amplitude reference voltage Vofs that should be supplied to the pixel circuits 10 is set to this upper limit.

Figure 9:
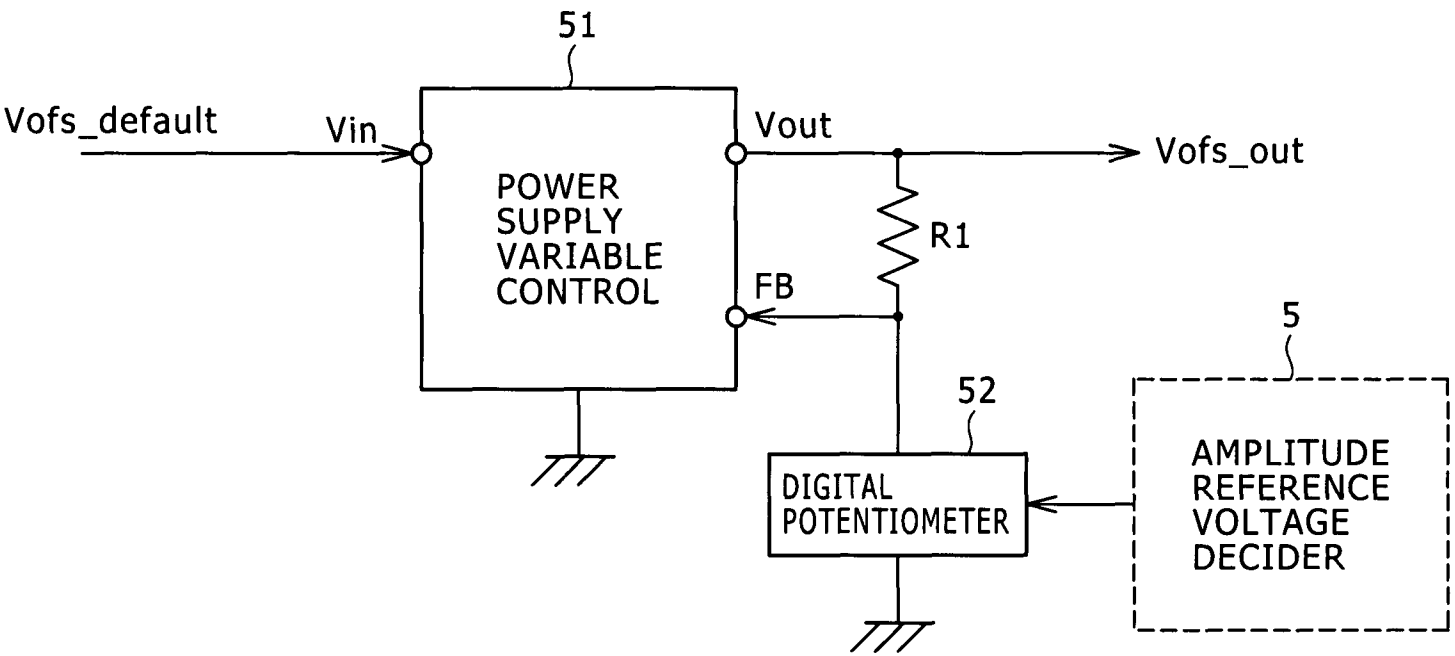
FIG. 9 is an explanatory diagram of an amplitude reference voltage changer according to the embodiment.

FIG. 9 shows one example of the configuration of the amplitude reference voltage changer 6. For example, as shown in FIG. 9, the amplitude reference voltage changer 6 includes a power supply variable controller 51, a digital potentiometer 52, and a resistor R1.

The power supply variable controller 51 obtains an output voltage Vout arising from voltage change of an input voltage Vin.

General power supply variable control circuits are roughly categorized into switching regulators and series regulators. However, the technique for variable control of the output voltage Vout is basically the same. When comparatively-large voltage change amounts are desired, the switching regulator is selected in most cases because of its efficiency.

The power supply variable controller 51 is provided with an FB terminal for feeding back the output voltage as a certain potential. By operation for keeping this potential at a certain constant value, the output voltage is stabilized. The FB potential is generally in a range of about 1 to 3 V. Therefore, the voltage variable control is allowed by a configuration in which the output voltage is divided by resistors so as to be connected to the FB terminal.

Specifically, because the FB potential is fixed at a certain value (e.g. 2 V), the ratio of the voltage division by resistors is changed to vary the output voltage.

For this purpose, the fixed resistor R1 is used as one resistor, and the digital potentiometer 52 that can digitally control the resistance change is used as the other resistor. The amplitude reference voltage decider 5 supplies a digital value for obtaining the calculated voltage value Vofs_out to the digital potentiometer 52 to thereby carry out change control of the resistance thereof. Due to this operation, the signal amplitude reference voltage Vofs with the voltage value Vofs_out is obtained as the output voltage Vout, and this output voltage is supplied to the respective pixel circuits 10 in the organic EL display panel module 1.

Figure 8:
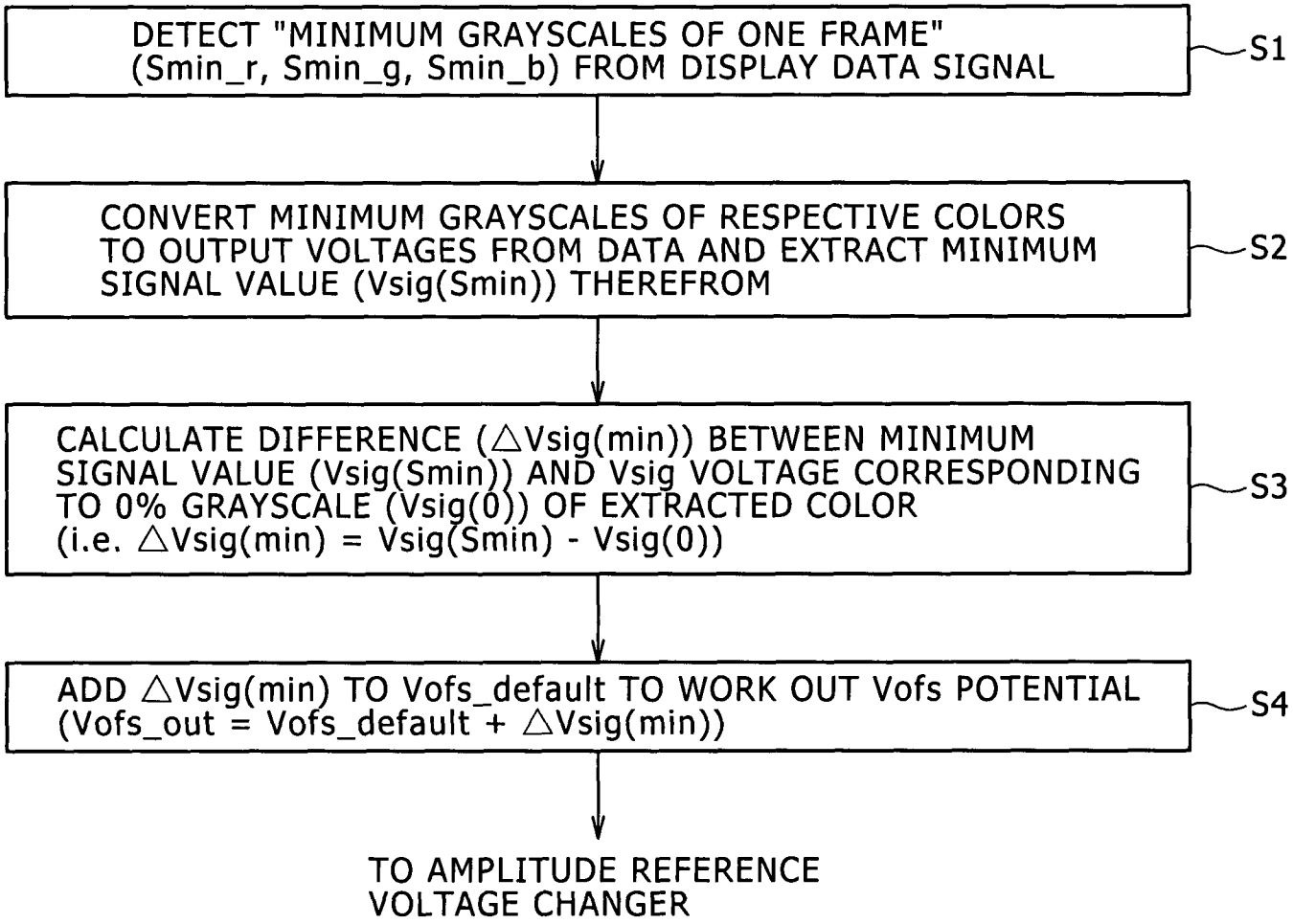
FIG. 8 is an explanatory diagram of processing for deciding the signal amplitude reference voltage according to the embodiment.

The above-described processing <S1> to <S4> of FIG. 8 is executed in every one-frame period. Thereby, the change control of the signal amplitude reference voltage Vofs is carried out in the amplitude reference voltage changer 6 in every one-frame period.

Due to this change control of the signal amplitude reference voltage Vofs, in the organic EL display panel module 1, the entire luminance is decreased and thus the power consumption is reduced, with the grayscale reproducibility kept in each frame.

The timing of the supply of the signal amplitude reference voltage Vofs obtained after the change control should be properly matched with the timing of the displaying of the present frame as the basis of the change control by the organic EL display panel module 1. Thus, as described above, the display data delaying unit 2 is provided in order to correct the response delay that occurs due to the processing time from the processing by the minimum grayscale detector 3 to the change control of the signal amplitude reference voltage Vofs by the amplitude reference voltage changer 6.

The proper delay amount of the display data delaying unit 2 is set as follows.

The factors in the occurrence of the delay are categorized into "(1) the delay due to the time from the detection of the minimum grayscale value of one frame to the calculation of the proper voltage value Vofs_out of the signal amplitude reference voltage Vofs" and "(2) the delay due to the time from the reception of the information on the voltage value Vofs_out by the amplitude reference voltage changer 6 to the reaching of the output voltage to the voltage value".

Regarding (1), at least delay of "one frame" occurs because the minimum grayscale value of one frame is calculated. As for (2), it can be assumed that this response delay is "αH" (H is the horizontal period), although depending on the performance of the power supply conversion circuit (it is generally considered that the response delay equivalent to several horizontal periods is possible). Therefore, data delaying by the time equal to "one frame+αH" is carried out by the display data delaying unit 2.

As described above, in the present embodiment, the minimum grayscale value of the pixels is detected and the signal amplitude reference voltage Vofs is changed based on the minimum grayscale value for each one frame. This feature lowers the entire luminance without deteriorating the grayscale characteristic of the display contents. This offers an advantageous effect that suppression of the entire luminance, i.e., suppression of the power consumption, can be realized while image quality lowering is suppressed to the minimum through simple control: the change of the signal amplitude reference voltage.

Furthermore, power consumption reduction can be realized without causing visual recognition of image quality lowering of the self-luminous flat panel display. Therefore, if the display device is battery-operating apparatus, the present embodiment can contribute to extension of the operating time. If the display device is apparatus that obtains power from an AC outlet, the present embodiment can contribute to power saving and electricity cost saving.

Various modification examples of the embodiment will be available.

For example, in the above-described example, the signal amplitude reference voltage Vofs common to all the pixel circuits is supplied. However, as the pixel circuits 10, the pixel circuits for red (R), the pixel circuits for green (G), and the pixel circuits for blue (B) are arranged. Thus, the line of the signal amplitude reference voltage Vofs may be independently provided for the pixel circuits of each of these colors, and the change processing of the signal amplitude reference voltage Vofs may be executed on a color-by-color basis. In this case, based on the minimum grayscale value of each color, the change control of the signal amplitude reference voltage Vofs of the corresponding color is carried out.

In the above-described example, the minimum grayscale value of each color is detected in the minimum grayscale detector 3. However, the following technique will also be available. Specifically, the minimum grayscale value is detected without separating the colors, and the optimum voltage value Vofs_out as the signal amplitude reference voltage Vofs is obtained based on the minimum grayscale value.

Moreover, the "minimum" grayscale value does not necessarily need to be used as the basis, but it will also be possible to control the signal amplitude reference voltage Vofs by using a value near the minimum grayscale value as the basis, based on the idea that a certain amount (e.g. an amount having no influence on the visually-recognizable image quality) of grayscales on the lower-luminance side may be collapsed.

In addition, in the above-described example, the detection of the minimum grayscale value and the conversion of the signal amplitude reference voltage Vofs are carried out in each one-frame period. Alternatively, the same operation may be carried out in every another unit period such as a two-frame period.

Although the pixel circuit configuration in the organic EL display panel module 1 is shown in FIG. 3, the embodiment of the present invention can be applied also to the case of employing a pixel circuit configuration other than that shown in FIG. 3. Particularly, the embodiment of the present invention is preferable for a display device in which the pixels are driven based on an active-matrix system.

In particular, the embodiment of the present invention can be applied to any pixel circuit as long as the pixel circuit carries out the following operation. Specifically, after the operation of cancelling the Vth characteristic of the drive transistor, the potential of the signal amplitude reference voltage Vofs is reproduced at the gate of the drive transistor and the potential Vofs−Vth is reproduced at the source thereof. Thereafter, by supplying the potential of the signal value Vsig to the gate, the voltage "Vth+(Vsig−Vofs)" is written as the gate-source voltage Vgs.

It should be understood by those skilled in the art that various modifications, combinations, sub-combinations and alternations may occur depending on design requirements and other factors insofar as they are within the scope of the appended claims or the equivalent thereof.

What is claimed is:

1. A display device comprising:

a display panel unit configured to include pixel circuits in each of which an organic electroluminescence device is used as a light emitting device and is driven to emit light with luminance dependent upon a voltage difference between a signal value voltage of an input display data signal and a signal amplitude reference voltage respectively supplied to the pixel circuits;

a voltage controller configured to carry out grayscale value detection for a display data signal to be supplied to the display panel unit in every predetermined period, and create voltage control information of the signal amplitude reference voltage by using a detected grayscale value; and a signal amplitude reference voltage changer configured to change a voltage value of the signal amplitude reference voltage to be supplied to the pixel circuits of the display panel unit, based on the voltage control information created by the voltage controller.

2. The display device according to claim 1, wherein the voltage controller carries out grayscale value detection for a display data signal to be supplied to the display panel unit in every one-frame period as the predetermined period, for detecting a minimum grayscale value in one frame, and the voltage controller calculates a signal value voltage to be input to the pixel circuits based on the detected minimum grayscale value and creates voltage control information of the signal amplitude reference voltage by using the calculated signal value voltage.

3. The display device according to claim 1, wherein the voltage controller is given information on an upper limit of the signal amplitude reference voltage and creates the voltage control information, which causes the signal amplitude reference voltage to be changed within a range under the upper limit.

4. The display device according to claim 1, wherein the voltage controller detects a minimum grayscale value of each of display colors for a display data signal to be supplied to the display panel unit in every one-frame period as the predetermined period, and calculates signal value voltages to be input to the pixel circuits based on the detected minimum grayscale values of the respective display colors, and the voltage controller creates voltage control information of the signal amplitude reference voltage by using a lowest signal value voltage among the calculated signal value voltages.

5. The display device according to claim 1, further comprising a display data delaying unit configured to delay a display data signal by a time of operation of changing a signal amplitude reference voltage by the voltage controller and the signal amplitude reference voltage changer, and supply the delayed display data signal to the display panel unit.

6. The display device according to claim 1, the signal amplitude reference voltage is supplied to gates of driving transistors of the pixel circuits.

7. A display driving method for a display device having a display panel unit that includes pixel circuits in each of which an organic electroluminescence device is used as a light emitting device and is driven to emit light with luminance dependent upon a voltage difference between a signal value voltage of an input display data signal and a signal amplitude reference voltage, the method comprising the steps of:

carrying out grayscale value detection for a display data signal to be supplied to the display panel unit in every predetermined period;

creating voltage control information of the signal amplitude reference voltage depending on a detected grayscale value; and changing a voltage value of the signal amplitude reference voltage to be supplied to the pixel circuits of the display panel unit, based on the voltage control information.

8. The display driving method according to claim 7, wherein the carrying out further comprises detecting, by the voltage controller, a minimum grayscale value in one frame;

calculating, by the voltage controller, a signal value voltage to be input to the pixel circuits based on the detected minimum grayscale value;

creating voltage control information of the signal amplitude reference voltage by using the calculated signal value voltage.

9. The display driving method according to claim 7, further comprising providing information on an upper limit of the signal amplitude reference voltage to the voltage controller, and creating the voltage control information, which causes the signal amplitude reference voltage to be changed within a range under the upper limit.

10. The display driving method according to claim 7, further comprising detecting, by the voltage controller, a minimum grayscale value of each of display colors for a display data signal to be supplied to the display panel unit in every one-frame period as the predetermined period;

calculating, by the voltage controller, signal value voltages to be input to the pixel circuits based on the detected minimum grayscale values of the respective display colors;

creating, by the voltage controller, voltage control information of the signal amplitude reference voltage by using a lowest signal value voltage among the calculated signal value voltages.

11. The display driving method according to claim 7, further comprising delaying, by a display data delaying unit, a display data signal by a time of operation of changing a signal amplitude reference voltage by the voltage controller and the signal amplitude reference voltage changer, and supplying the delayed display data signal to the display panel unit.

12. The display driving method according to claim 7, further comprising supplying the signal amplitude reference voltage to gates of driving transistors of the pixel circuits.

* * * * *